US009790943B2

(12) United States Patent
Iwano et al.

(10) Patent No.: US 9,790,943 B2
(45) **Date of Patent: *Oct. 17, 2017**

(54) SCROLL-TYPE FLUID MACHINE WITH GREASE-LUBRICATED ORBITING BEARING

(71) Applicant: Hitachi Industrial Equipment Systems Co., Ltd., Chiyoda-ku, Tokyo (JP)

(72) Inventors: Kiminori Iwano, Sagamihara (JP); Yoshio Kobayashi, Ebina (JP); Natsuki Kawabata, Shizuoka (JP); Toshikazu Harashima, Tama (JP); Shumpei Yamazaki, Ebina (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 191 days.

This patent is subject to a terminal disclaimer.

(21) Appl. No.: 14/608,427

(22) Filed: Jan. 29, 2015

(65) Prior Publication Data

US 2015/0147215 A1 May 28, 2015

Related U.S. Application Data

(63) Continuation of application No. 13/353,344, filed on Jan. 19, 2012, now Pat. No. 8,979,515.

(30) Foreign Application Priority Data

Jun. 10, 2011 (JP) ..... 2011-129775

(51) Int. Cl.
*F01C 1/02* (2006.01)
*F03C 2/00* (2006.01)
(Continued)

(52) U.S. Cl.
CPC ..... *F04C 29/0092* (2013.01); *F01C 21/06* (2013.01); *F04C 15/0096* (2013.01);
(Continued)

(58) Field of Classification Search
CPC .. F04C 18/02; F04C 18/0215; F04C 15/0096; F04C 23/008; F04C 27/005;
(Continued)

(56) References Cited

U.S. PATENT DOCUMENTS 6,450,791 B1 9/2002 Kawabata et al.
7,329,108 B2 2/2008 Tsuchiya et al.
(Continued)

FOREIGN PATENT DOCUMENTS

JP 08-100777 A 4/1996
JP 2001-123969 A 5/2001
(Continued)

OTHER PUBLICATIONS

Japanese Office Action dated Jul. 17, 2013 {One (1) page}.
JP 08100777 A—Komai et al., Scroll Type Fluid Machine—Apr. 16, 1996—English translation.

*Primary Examiner* — Theresa Trieu
(74) *Attorney, Agent, or Firm* — Crowell & Moring LLP

(57) ABSTRACT

A scroll-type fluid machine reduces intrusion of abrasion powders, generated by sliding of a conductor causing an orbiting scroll side and a fixed scroll side to be conducted, into a compression chamber, and improves reliability of a compressor. The scroll-type machine includes a casing, a fixed scroll having a flange surface attached to the casing, and a wrap portion provided at an end plate, an orbiting scroll having a wrap portion provided at the end plate, and provided in an opposed relationship with the fixed scroll, a drive shaft connected through a crank portion to the orbiting scroll, an orbiting bearing, a face seal portion arranged between the orbiting scroll and the fixed scroll, a cooling fan, and an orbiting scroll side conductive brush.

16 Claims, 7 Drawing Sheets

(51) Int. Cl.

| | |
|---|---|
| ***F03C 4/00*** | (2006.01) |
| ***F04C 2/00*** | (2006.01) |
| ***F04C 29/00*** | (2006.01) |
| ***F01C 21/06*** | (2006.01) |
| ***F04C 15/00*** | (2006.01) |
| ***F04C 27/00*** | (2006.01) |
| ***F04C 29/04*** | (2006.01) |
| ***F04C 18/02*** | (2006.01) |
| *F04C 23/00* | (2006.01) |

(52) U.S. Cl.
CPC ..... *F04C 18/0215* (2013.01); *F04C 27/005* (2013.01); *F04C 29/04* (2013.01); *F04C 23/008* (2013.01); *F04C 2240/50* (2013.01)

(58) Field of Classification Search
CPC .... F04C 29/0007; F04C 29/04; F01C 21/001; F01C 21/06; F01C 1/0215
USPC ..... 418/15, 85, 92, 101, 55.1–55.6, 57
See application file for complete search history.

(56) References Cited

U.S. PATENT DOCUMENTS

| | | | |
|---|---|---|---|
| 2004/0081561 | A1 | 4/2004 | Iwanami et al. |
| 2008/0152525 | A1 | 6/2008 | Tsuchiya et al. |
| 2010/0221134 | A1 | 9/2010 | Kanaizumi et al. |

FOREIGN PATENT DOCUMENTS

| | | | |
|---|---|---|---|
| JP | 3205474 | B2 | 6/2001 |
| JP | 3866925 | B2 | 1/2007 |
| JP | 2010-203289 | A | 9/2010 |

SCROLL-TYPE FLUID MACHINE WITH GREASE-LUBRICATED ORBITING BEARING

This application is a continuation of U.S. application Ser. No. 13/353,344, filed Jan. 19, 2012, which claims priority from Japanese Patent Application No. JP 2011-129775, filed Jun. 10, 2011, the disclosures of which are expressly incorporated by reference herein.

BACKGROUND OF THE INVENTION

1. Field of the Invention

The present invention relates to a scroll fluid machine and, in particular, to a scroll fluid machine in which an orbiting bearing is grease-lubricated.

2. Description of the Related Art

Japanese Patent No. 3866925 discloses a scroll compressor in which, as measures for bearing damage occurring due to static electricity, a conductor which is constructed for causing the static electricity to discharge from an orbiting scroll side to a fixed scroll side is provided at a shaft end of a crankshaft or of an auxiliary crankshaft.

Furthermore, Japanese Patent No. 3205474 discloses a scroll-type fluid machine which has a structure in which a cooling fan which generates cooling air is provided at an end portion of a drive shaft and a fan casing is adapted to conduct the cooling air generated by the cooling fan to each of a back surface of a fixed scroll and a back surface of an orbiting scroll.

In a case where, in order to cool a fixed scroll, an orbiting scroll, and the like which are brought into a high-temperature state by compression-heat or the like in such a scroll-type compressor provided with the conductor, as disclosed in Japanese Patent No. 3866925, the cooling fan is provided so as to conduct the cooling air to the fixed scroll, the orbiting scroll and the like as in the scroll-type fluid machine disclosed in Japanese Patent No. 3205474A face seal preventing intrusion of dust and the like into a compression chamber and a slide portion for the conductor of Japanese Patent No. 3866925 which is provided at an end plate portion of the orbiting scroll are arranged in a cooling air path. In this case, the conductor slides relative to the slide portion to thereby produce abrasion powders which are scattered by cooling air in a compressor body and enter a slide surface of the face seal. In a case where the face seal is worn, the abrasion powders produced by the conductor intrude into the compression chamber and there is a possibility that reliability of compressed air will be impaired.

In view of the above-mentioned problems, an object of the present invention is to provide a scroll-type fluid machine which reduces intrusion of abrasion powders, generated by sliding of a conductor causing an orbiting scroll side and a fixed scroll side to be conducted, into a compression chamber, and improves reliability of a compressor.

SUMMARY OF THE INVENTION

In order to address the above-mentioned problems, according to the present invention, there is provided a scroll-type fluid machine which comprises a casing, a fixed scroll having a flange surface attached to the casing, and a wrap portion provided at an end plate, an orbiting scroll having a wrap portion provided at the end plate and orbitingly provided in an opposed relationship with the fixed scroll, a drive shaft connected through a crank portion to the orbiting scroll and performing rotation-drive, an orbiting bearing causing the drive shaft to be supported on the orbiting scroll, a face seal portion arranged between the orbiting scroll and the fixed scroll, a cooling fan supplying cooling air into an interior of the casing, and an orbiting scroll side conductive brush causing the orbiting scroll and the casing to be conducted, in which a slide surface for the orbiting scroll side conductive brush is arranged at a position except a position at which cooling air produced by the cooling fan is supplied to the face seal portion.

According to another aspect of the present invention, there is provided a scroll-type fluid machine which comprises a casing, a fixed scroll having a flange attached to the casing, and a wrap portion provided at an end plate, an orbiting scroll having a wrap portion provided at the end plate and orbitingly provided in an opposed relationship with the fixed scroll, a drive shaft connected through a crank portion to the orbiting scroll and performing rotation-drive, a face seal portion arranged between the orbiting scroll and the fixed scroll, a cooling fan supplying cooling air into an interior of the casing, and a drive shaft side conductive brush causing the drive shaft and the casing to be conducted, in which a slide surface for the drive shaft side conductive brush is arranged at a position except a position at which cooling air produced by the cooling fan is supplied to the face seal portion.

According to the present invention, it is possible to provide a scroll-type fluid machine which reduces intrusion of abrasion powders, generated by sliding of a conductor causing an orbiting scroll side and a fixed scroll side to be conducted, into a compression chamber, and improves reliability of a compressor.

BRIEF DESCRIPTION OF THE SEVERAL VIEWS OF THE DRAWINGS

These and other features of the present invention will become readily apparent when considered in reference to the following detailed description when taken in conjunction with the accompanying drawings.

Preferred embodiments of the present invention will be described in detail based on the followings, wherein.

DETAILED DESCRIPTION OF THE INVENTION

Figure 1:
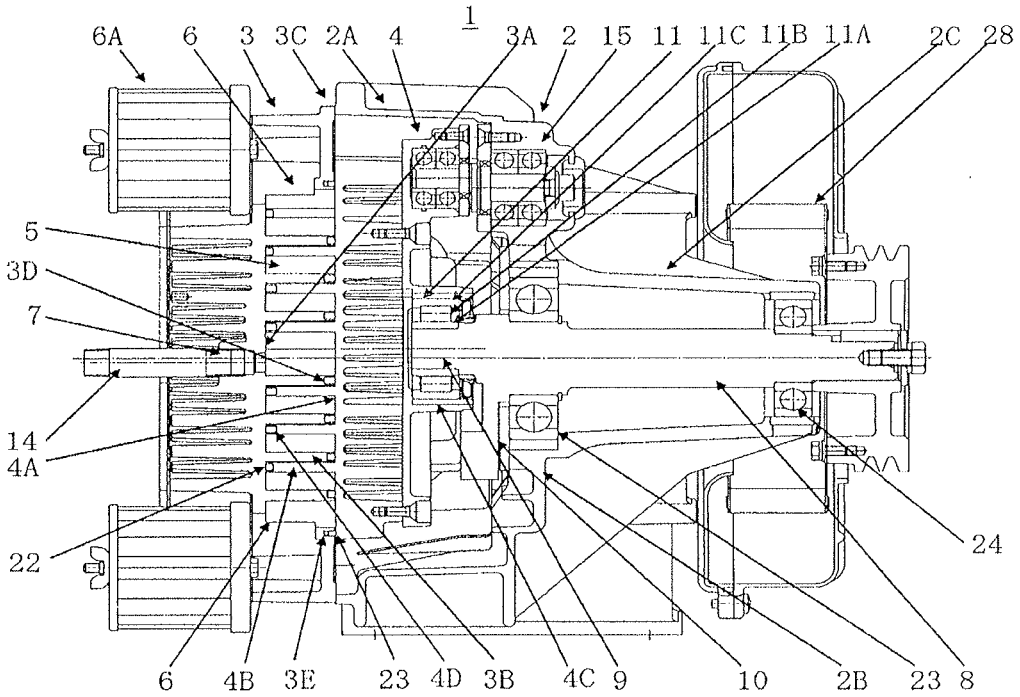
FIG. 1 is a vertical cross-sectional view of a compressor in an embodiment of the present invention.

A scroll-type fluid machine according to an embodiment of the present invention will be explained hereinafter with reference to FIGS. 1 to 13. In the drawings, a compressor body 1 employs a scroll-type air compressor and includes a casing 2, a fixed scroll 3, an orbiting scroll 4A drive shaft 8, a crank portion 9, rotation preventing mechanisms 15, etc. which will be discussed hereinafter.

The casing 2 which constitutes an outer shell of the compressor body 1 is formed as bottomed cylindrical body which is closed on one side thereof in an axial direction and opened on the other side thereof in the axial direction, as shown in FIG. 1. Namely, the casing 2 is mainly composed of a cylindrical portion 2A opened on the other side thereof in the axial direction (a below-mentioned fixed scroll 3 side), an annular bottom portion 2B formed integrally with one side of the cylindrical portion 2A in an axial direction and extending so as to face inward in a radial direction, and a cylindrical bearing mounting-portion 2C protruding toward both sides in the axial direction from an inner circumferential side of the bottom portion 2B.

Moreover, the orbiting scroll 4, the crank portion 9, a plurality of rotation preventing mechanisms 15, etc. which will be discussed hereinafter are housed in the cylindrical portion 2A of the casing 2. Moreover, the plurality of rotation preventing mechanisms 15 (only one rotation preventing mechanism is shown in FIG. 1) are arranged at a predetermined interval in a circumferential direction between the bottom portion 2B side of the casing 2 and an end plate 4A side of the orbiting scroll 4 which will be discussed hereinafter.

The fixed scroll 3 is a single scroll member which is fixedly provided on a flange surface (casing 2 side) on an opening end side of the casing 2 (cylindrical portion 2A). The fixed scroll 3 is mainly composed of an end plate 3A formed in a circular-disc shape, a spiral wrap portion 3B provided so as to stand up from a surface of the end plate 3A, and a plate-shaped support portion 3C which is provided on an outer circumferential side of the end plate 3A so as to surround the wrap portion 3B from the outside in the radial direction and has a flange surface (fixed scroll 3 side) which is fixed on the flange surface (casing 2 side) on the opening end side of the casing 2 (cylindrical portion 2A) by a plurality of bolts (not shown).

The fixed scroll 3 is mainly composed of an end plate 3A formed in a circular-disc shape, a spiral wrap portion 3B provided so as to stand up from a surface of the end plate 3A, and a plate-shaped support portion 3C which is provided on an outer circumferential side of the end plate 3A so as to surround the wrap portion 3B from the outside in the radial direction and has a flange surface (fixed scroll 3 side) which is fixed on the flange surface (casing 2 side) on the opening end side of the casing 2 (cylindrical portion 2A) by a plurality of bolts (not shown). Moreover, on an outer diameter of a back surface side of the orbiting scroll 4 (end plate 4A), the below-mentioned rotation preventing mechanism 15 are arranged at a predetermined interval in a circumferential direction between the orbiting scroll 4. And the bottom portion 2B of the casing 2. The boss portion 4C of the orbiting scroll 4 is arranged with its center being offset relative to a center of the fixed scroll 3 in a radial direction by a predetermined size (orbiting radius).

A plurality of compression chambers 5 which are defined between the wrap portion 3B of the fixed scroll 3 and the wrap portion 4B of the orbiting scroll 4 reformed with the end plates 3A, 4A being interposed between the wrap portions 3B, 4B, by casing the wrap portion 4B of the orbiting scroll 4 to be arranged so as to be superposed on the wrap portion 3B of the fixed scroll 3 as shown in FIG. 1.

A surface treatment such as an alumite treatment is applied to both of the fixed scroll 3 and the orbiting scroll 4, whereby improvement in corrosion resistance is realized.

Tip seals 22 which are fitted in groove portions respectively provided in tip ends of the wrap portions 3B, 4B respectively slide on the end plate 4A, 3A to prevent mutual leakage among the plurality of compression chambers 5.

A face seal 23 is fitted in an annular groove 3E which is provided at a matching surface of the support portion 3C of the fixed scroll 3 with the casing 2 and around the outside of an outermost circumferential portion of the compression chamber 5. The face seal 23 is arranged between the fixed scroll 3 and the orbiting scroll 4, slides on the end plate 4A of the orbiting scroll 4. And prevents dust and the like from intruding into the interiors of the compression chambers 5.

The tip seals 22 and the face seal 23 are both formed of heat resistant resins.

A suction opening 6 which is provided on an outer circumferential side of the fixed scroll 3 sucks up air from the outside via, for example, a suction filer 6A or the like. This air is successively compressed in the respective compression chambers 5 according to orbiting operation of the orbiting scroll 4.

A delivery port 7 which is provided on a center side of the fixed scroll 3 delivers compressed air toward a below-mentioned storage tank (not shown) side from a compression chamber 5 on an innermost diameter side of the compression chambers 5. Namely, the orbiting scroll 4 is driven by an electric motor (not shown) or the like through a blow-mentioned drive shaft 8 and crank portion 9, and performs the orbiting movement relative to the fixed scroll 3, in a state where it is prevented from self-rotating by the below-mentioned rotation preventing mechanisms 15.

Thereby, a compression chamber 5 on an outer diameter side of the plurality of compression chambers 5 sucks up the air from the suction opening 6 of the fixed scroll 3 and the air is successively compressed in the respective compression chambers 5. The compression chamber 5 on an inner diameter side delivers the compressed air toward the outside from the delivery port 7 located on the center side of the end plate 3A.

The drive shaft 8 which is rotatably provided at the bearing mounting-portion 2C of the casing 2 via bearings 29, 30 is detachably connected, at a proximal end side thereof (one side in the axial direction) projecting out of the casing 2, to a drive source for the unshown electric motor or the like, and is rotation-driven by the electric motor. Moreover, the boss portion 4C of the orbiting scroll 4 is orbitingly connected to a distal end side of the drive shaft 8 (the other side in the axial direction) via the below-mentioned crank portion 9 and orbiting bearing 11, and the drive shaft 8 rotation-drives the orbiting scroll 4. In order to stabilize the orbiting operation of the orbiting scroll 4A balance weight 10 is provided at the drive shaft 8. The balance weight 10 is rotated together with the drive shaft 8 in a case of the compressor operation.

The crank portion 9 which is integrally provided at the distal end side of the drive shaft 8 is connected to the boss portion 4C of the orbiting scroll 4 via the below-mentioned orbiting bearing 11. The crank portion 9 is rotated together with the drive shaft 8. The rotation of the crank portion 9 at this time is converted, via the orbiting bearing 11, into the orbiting operation of the orbiting scroll 4.

The plurality of rotation preventing mechanisms 15 (only one rotation preventing mechanism 15 is shown in FIG. 15) which are provided between the bottom portion 2B of the casing 2 and the back side of the orbiting scroll 4. Are realized by auxiliary crank mechanisms, for example. The rotation preventing mechanisms 15 prevent a rotation of the orbiting scroll 4. And cause thrust load from the orbiting scroll 4 to be received by the bottom portion 2B side of the casing 2. Incidentally, as the rotation preventing mechanisms 15, for example, ball coupling mechanisms, Oldham's couplings, or the like may be employed in lieu of the auxiliary crank mechanisms.

A discharge pipe 14 which is connected to the delivery port 7 of the fixed scroll 3 constitutes an ejection flow passage which makes a communication between the storage tank (not shown) and the delivery port 7.

The orbiting bearing 11 is provided between the boss portion 4C of the orbiting scroll 4. And the crank portion 9. An inner race 11A of the orbiting bearing 11 is fitted on the shaft. A roller 11B and outer race 11C of the orbiting bearing 11 are fitted in the boss portion 4C in a state where they are combined with each other. The orbiting bearing 11 causes the boss portion 4C of the orbiting scroll 4 to be orbitingly supported on the crank portion 9 and compensates for the orbiting operation of the orbiting scroll 4 with respect to the axial line of the drive shaft 8 with a predetermined orbiting radius.

A cooling fan 28 which is provided on the proximal end side of the drive shaft 8 rotates together with the drive shaft 8, when the drive shaft 8 is rotation-driven by the electric motor and the compressor is operated, and supplies the cooling air to the fixed scroll 3 and the orbiting scroll 4 in the casing 2.

Figure 2:
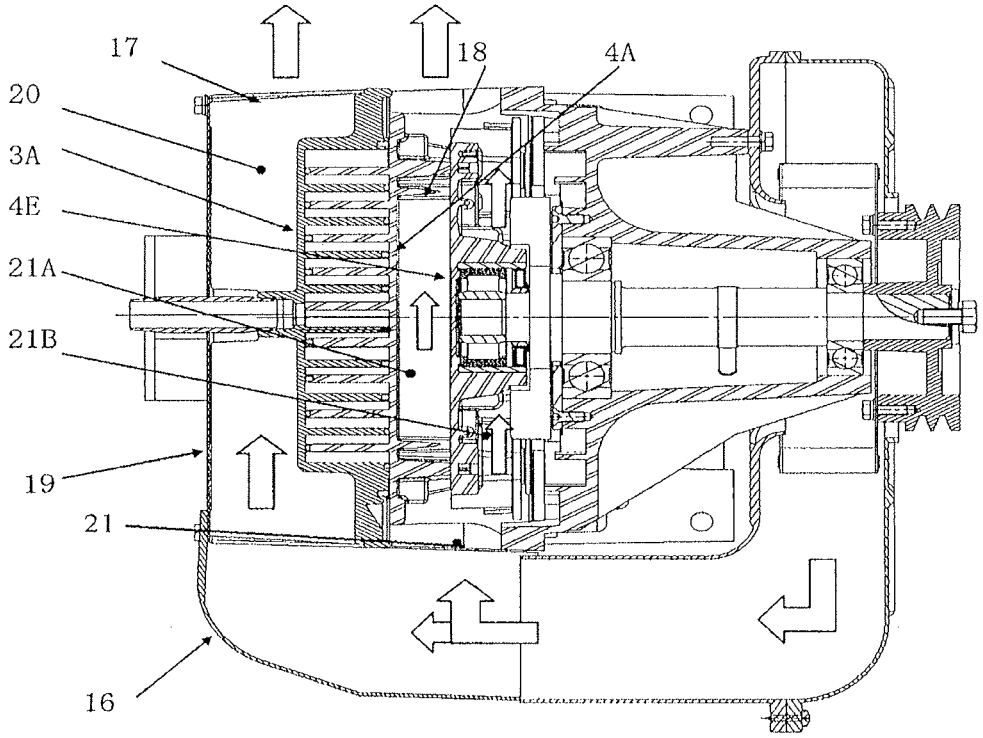
FIG. 2 is a horizontal cross-sectional view of the compressor in the embodiment of the present invention.

Referring now to FIG. 2, flow of the cooling air produced by the cooling fan 28 will be explained.

A fan duct 16 is formed on the outer diameter sides of the fixed scroll 3 and orbiting scroll 4. And conducts the cooling air produced by the rotation of the cooling fan 28 to the fixed scroll 3 and the orbiting scroll 4 from the outer diameter sides of the fixed scroll 3 and orbiting scroll 4. The cooling air is distributed to the fixed scroll 3 and the orbiting scroll 4By a protrusion which is provided at the fan duct 16.

A space between the casing 2, and the fixed scroll 3 and the orbiting scroll 4. And the fan duct 16 define a cooling air path. The cooling air is supplied to the fixed scroll 3 and the orbiting scroll 4. The cooling air path includes the fan duct 16, a fixed scroll side cooling air path 20, an orbiting scroll side cooling air path 21, and a side surface side cooling air path. The fixed scroll side cooling air path 20 is formed between the back surface of the end plate 3A of the fixed scroll 3 and the casing 2. The orbiting scroll side cooling air path 21 is formed on the back surface side of the end plate 4A of the orbiting scroll 4 (between the back of the end plate 4A of the orbiting scroll 4 And the casing 2). The side surface side cooling air path is formed on the side surface sides of the fixed scroll 3 and orbiting scroll 4.

The cooling air which is to be supplied to the fixed scroll side is produced between the back surface of the end plate 3A of the fixed scroll 3 and the casing 2 as indicated in FIG. 2 by an arrow and passes the fixed scroll side cooling air path 20 which is formed by, for example, the back surface side of the fixed scroll end plate 3A, a cooling fin cover 19, and stationary side cooling fins 17, and is discharged out of the body. Similarly, the cooling air which is to be supplied to the orbiting scroll side passes the orbiting scroll side cooling air path 21. Moreover, the orbiting scroll side cooling air path 21 is branched into: a cooling fin side cooling air path 21A which is formed by the back surface of the end plate 4A and a back surface plate 4E and in which the cooling air passes between orbiting side cooling fans; and a back surface plate side air cooling path 21B formed by the back surface plate 4E and the casing 2. The cooling air is then discharged out of the body. The cooling air which is supplied to the side surfaces of the fixed scroll 3 and orbiting scroll 4 passes the side surface side cooling air path and is discharged out of the body.

Figure 3:
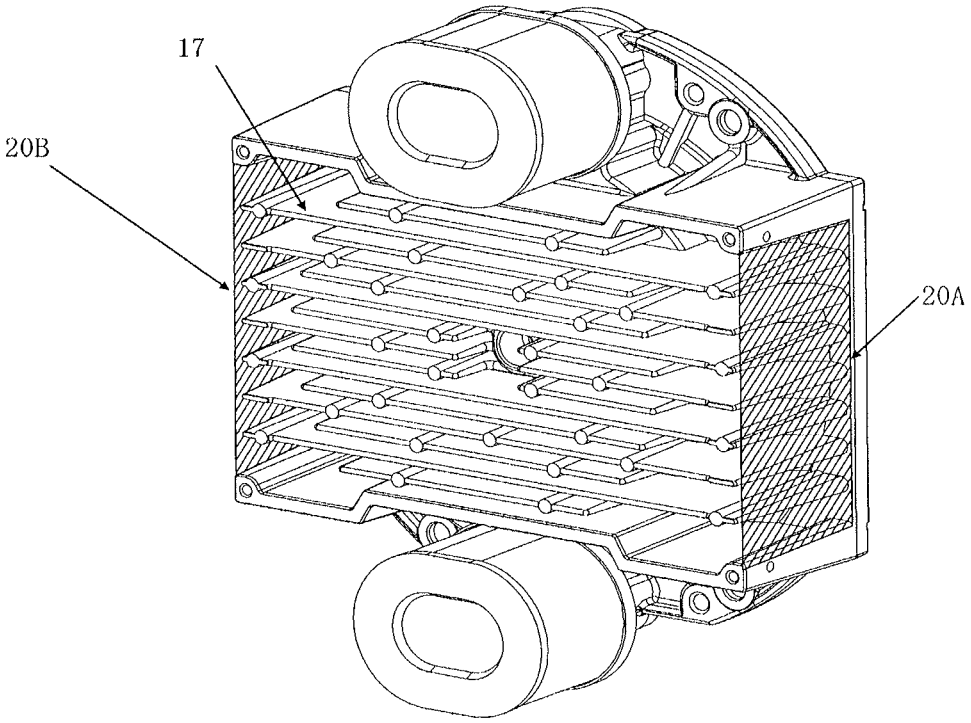
FIG. 3 is an arrow view of a fixed scroll of the compressor in the embodiment of the present invention.

As shown in FIG. 3, the plurality of stationary side cooling fins 17 which are provided on the back surface side of the fixed scroll 3 are arranged at a predetermined interval on the back surface of the end plate 3A so as stand up and linearly extend parallel to each other from the one end side toward the other end side of the fixed scroll 3 in a radial direction (a left and right direction). Thereby, a structure which does not block the flow of the cooling air is provided.

Figure 4:
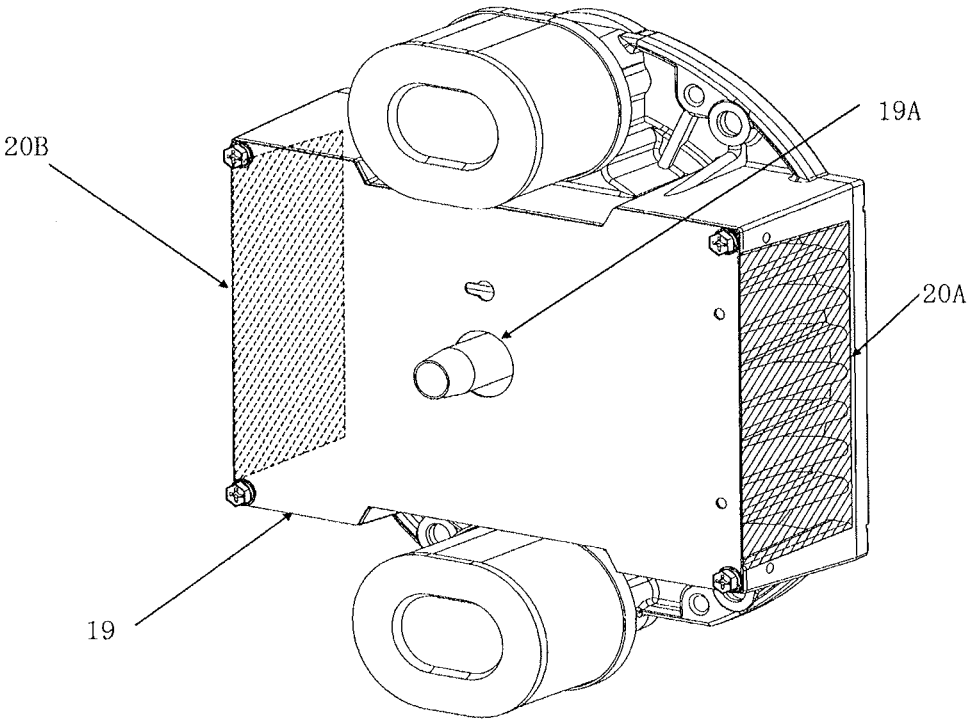
FIG. 4 is an arrow view of the fixed scroll of the compressor in the embodiment of the present invention.

As shown in FIG. 4, the cooling fin cover 19 which is attached to the back surface side of the fixed scroll 3 surrounds the entire stationary side cooling fins 17, to thereby form the below-mentioned fixed scroll side cooling air path 20 between the cooling fin cover 19 and the back surface of the fixed scroll 3. Moreover, a fixed scroll side inlet 20A which serves as an entrance of the fixed scroll side cooling air path 20 is formed in one side of the cooling fin cover 19 in the left and right direction (radial direction). A fixed scroll side outlet 20B which serves as an exit of the fixed scroll side cooling air path 20 is formed on the other side of the cooling fin cover 19 in the left and right direction. Moreover, a hole 19A through which a discharge pipe 14 is inserted is formed on a center side of the cooling fin cover 19.

A plurality of orbiting side cooling fins 18 which are provided on the back side of the orbiting scroll 4 are arranged at a predetermined interval on the back surface of the end plate 4A so as to stand up and linearly extend parallel to each other from the one side toward the other side of the orbiting scroll 4 in the radial direction (left and right direction).

In this way, the orientation of the orbiting side cooling fins 18 and the orientation of the stationary side cooling fins 17 are directed in the same direction, so that efficient cooling is made possible by the flow of the cooling air in the same direction.

While in order to efficiently supply the cooling air to the orbiting side cooling fins 18 and the stationary side cooling fans 17, the cooling air which is produced by the cooling fan 28 is supplied to the fixed scroll 3 and the orbiting scroll 4 from the side surface side through the fan duct 16 provided on the outer diameter sides of the fixed scroll 3 and orbiting scroll 4 in this embodiment, if a structure which can supply the cooling air to the fixed scroll 3 and the orbiting scroll 4 is employed, for example, the cooling air may be supplied from the back side surface of the fixed scroll 3 or the back surface side of the orbiting scroll 4 without providing the fan duct 16.

Figure 5:
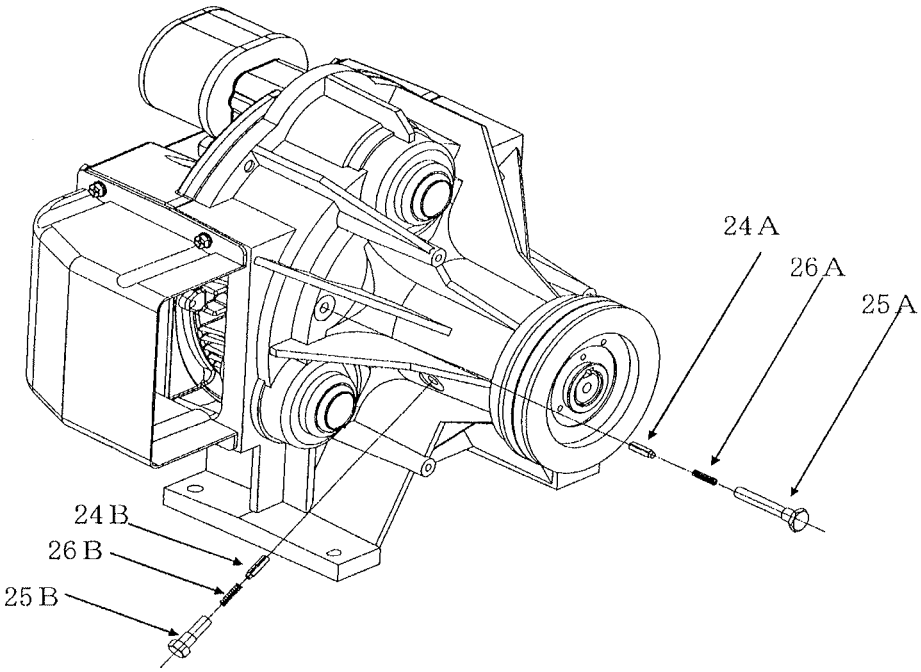
FIG. 5 is an arrow view of a conductive brush structure in the embodiment of the present invention.

Referring now to FIG. 5, prevention of white layer-delamination of the orbiting bearing 11 by providing an orbiting scroll side conductive brush 24A and a drive shaft side brush 24B will be explained.

The cause of the white layer-delamination of the orbiting bearing 11 will be explained. It is considered that the white layer-delamination of the orbiting bearing 11 is that hydrogen ions intrude into a bearing steel due to an electrical charge of static electricity to thereby form a brittle layer from which the delamination occurs. The electrical charge of static electricity occurs when the drive shaft is insulated with respect to the orbiting scroll 4.

In order to prevent the white layer-delamination of the orbiting bearing 11, it is necessary to prevent the electrical charges of the orbiting scroll 4 And the drive shaft 8 which are brought to an insulated state by a lubricant in the bearing during the compressor operation. In this embodiment, the orbiting scroll side conductive brush 24A and the drive shaft side conductive brush 24B are provided in order to prevent the electrical charges of the orbiting scroll 4 and the drive shaft 8.

The orbiting scroll side conductive brush 24A shown in FIG. 5 is housed in a holder 25A fitted in the casing 2 and is pushed, via a spring 26A also housed in the holder 25A, against a slide surface for a slide plate 27 provided at the back surface plate 4E of the orbiting scroll 4 and slides. Thereby, the orbiting scroll 4, the casing 2, and the fixed scroll 3 are electrically conducted. Moreover, the drive shaft side brush 24B is housed in a holder 25B fitted in the casing 2 and is pushed, via a spring 26B also housed in the holder 25B, against a slide surface on the drive shaft 8, and slides. Thereby, the casing 2 and the drive shaft 8 are electrically conducted. Thus, by providing the orbiting scroll side conductive brush 24A and the drive shaft side conductive brush 24B, the orbiting scroll 4 and the drive shaft 8 become the conducted state, and the white layer-delamination of the orbiting bearing 11 causing the orbiting scroll 4 to be supported on the drive shaft 8 can be prevented.

Incidentally, while the holder 25A of the orbiting scroll side conductive brush 24A is fitted in the casing 2 as described above, as far as a structure which allows the casing 2 and the orbiting scroll 4 to be electrically conducted is employed, it is not limited to the above-mentioned structure and, for example, the holder 25A which is fitted in the orbiting scroll 4 may be provided and the slide plate 27 may be provided on the casing 2 side. Similarly, regarding the drive shaft side brush 24B, if a structure which allows the orbiting scroll 4 and the drive shaft 8 to be electrically conducted is employed, the structure is not limited to the above-mentioned structure.

More concretely, the roller 11B and the outer race 11C which are fitted in the boss portion 4C of the orbiting scroll 4, in a state where the casing 2 and the orbiting scroll 4 are combined with each other, are made the same electrical potential through the orbiting scroll side conductive brush 24A. Moreover, the casing 2 and the inner race 11A fitted on in the drive shaft 8 are made the same electrical potential through the drive shaft side brush 24B. Thereby, the orbiting scroll 4 and the drive shaft 8 are made the same electrical potential, the electrical charge is prevented and the white layer-delamination of the orbiting bearing 11 is prevented.

Incidentally, for example, if lubricants which include conductive agents (carbon or the like) are applied to the bearings 29, 30, the orbiting scroll 4 and the drive shaft 8 are made the same electrical potential, so that the drive shaft side conductive brush 24B is unnecessary. Moreover, if lubricants which include conductive agents (carbon or the like) are applied to the rotation preventing mechanisms 15, the casing 2 and the orbiting scroll 4 are made the same electrical potential, so that the orbiting scroll side conductive brush 24A becomes unnecessary. Therefore, in order to prevent the white layer-delamination of the orbiting bearing 11, both of the orbiting scroll side conductive brush 24A and the drive shaft side conductive brush 24B are not necessarily required. However, in this embodiment, the case where at least one of them is employed will be explained.

In a case where a slide portion for the orbiting scroll side conductive brush 24A is provided at the orbiting scroll 4, the setting place of it is inside the cooling air path. In this case, abrasion powders are scattered by the cooling air and there is a possibility that the abrasion powders will intrude into the slide surface for the face seal 23.

The slide portion for the orbiting scroll side conductive brush 24A is subjected to small surface finish in its surface roughness by a process such as grinding or the like in order to improve the abrasive resistance of the orbiting scroll side conductive brush 24A. Therefore, the abrasion powders of the orbiting scroll side conductive brush 24A which are produced at the slide portion become considerably fine particles which enter an alumite-treated and corrugated surface of the slide portion for the face seal 23 of the end plate 4A or the like, and become a cause of making the face seal 23 unexpectedly worn to thereby remarkably reduce the life span of the face seal 23.

If the face seal 23 reaches a wear-amount limit, dust and the like which are contained in the cooling air intrude into the compression chambers and facilitate the wearing of the tip seal 22. If the tip seal 22 reaches a wear-amount limit, sealability is lowered to increase re-compression in the compression chambers, the temperature of the fixed scroll 3 and the orbiting scroll 4 which form the compression chambers is considerably increased, and they are damaged by contact of the wrap portions 3B, 4B due to thermal deformation.

In this way, by the abrasion powders of the orbiting scroll side conductive brush 24A, the face seal 23 and the tip seal 22 reach the wear-amount limits at time very shorter than general maintenance time and there is a possibility that the compressor will be broken.

Therefore, in this embodiment, the slide surface for the orbiting scroll side conductive brush 24A is arranged at a position except for a position in which the cooling air generated by the cooling fan 28 is supplied to the face seal 23. Thereby, the abrasion powders which are produced by the sliding of the orbiting scroll side conductive brush 24A and the slide plate 27 can be reduced from intruding into the face seal 23 by the cooling air.

Referring now to FIGS. 6-11, the position in which the slide surface for the orbiting scroll side conductive brush 24A is provided will be explained.

Figure 6:
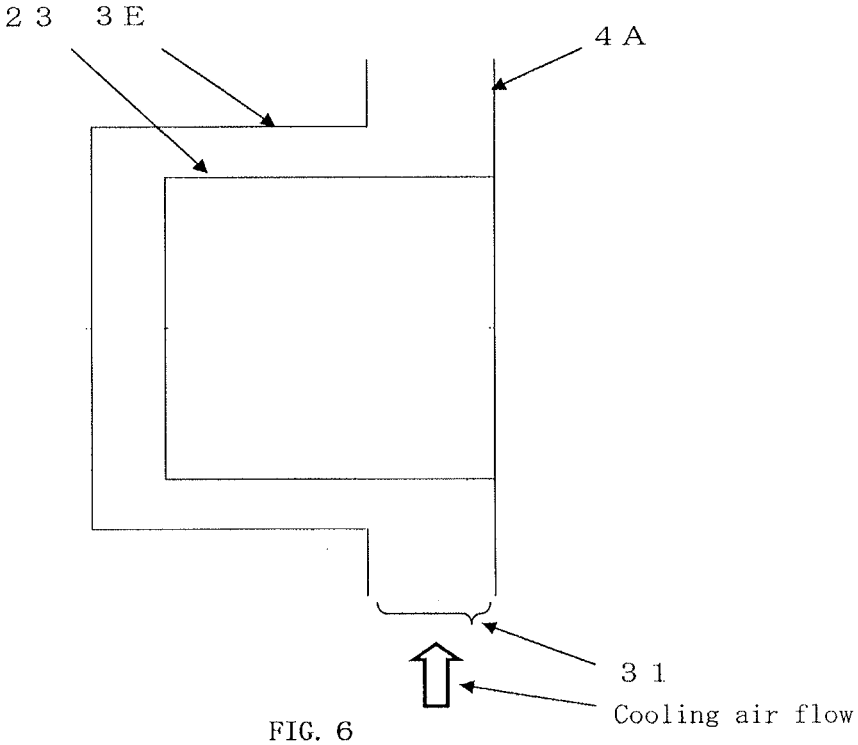
FIG. 6 is an enlarged view of a face seal periphery in FIG. 2.
Figure 7:
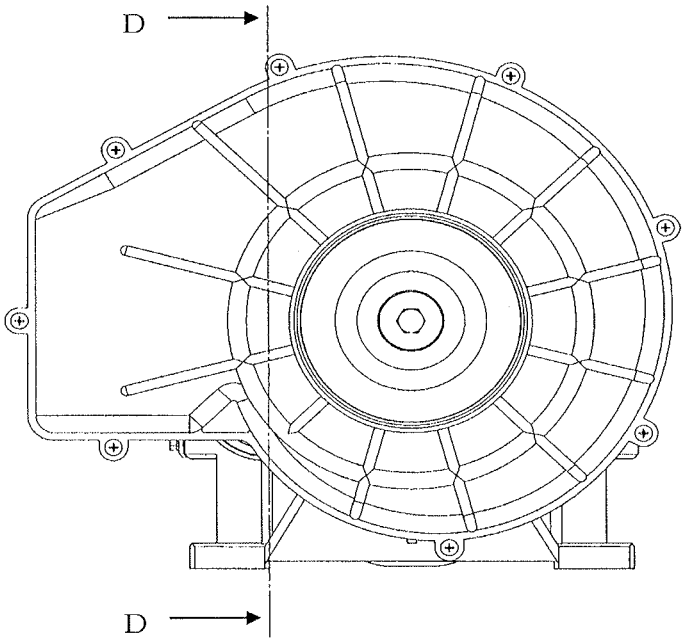
FIG. 7 is a rear view of the scroll compressor in the embodiment of the present invention.

FIG. 6 is an enlarged horizontal cross-sectional view of the periphery of the face seal 23. As shown in FIG. 6, the face seal 23 is provided between the end plate 4A of the orbiting scroll 4 and the support portion 3C for the fixed scroll 3 and covered with the annular groove 3E. There is a possibility that the cooling air from the side surface side cooling air path of the cooling air paths will be supplied to the face seal 23 from a clearance 31 between the annular groove 3E for the fixed scroll 3 and the end plate 4A of the orbiting scroll 4.

Figure 8:
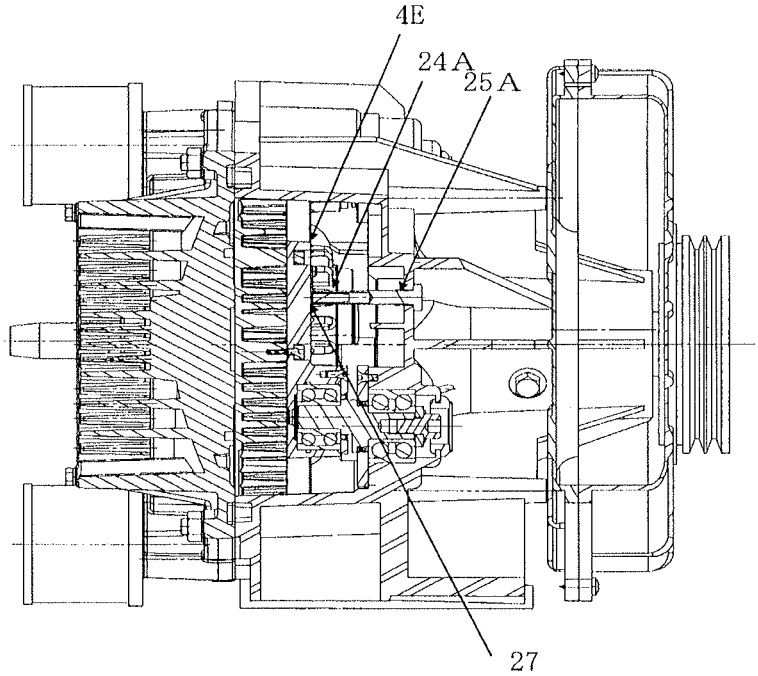
FIG. 8 is a cross-sectional view taken along a line D-D in FIG. 7.

Therefore, in this embodiment, the slide portion for the orbiting scroll side conductive brush 24A is provided on the back surface side (the orbiting scroll side cooling air path 21) which is located on the right side in FIG. 6 with respect to the end plate 4A of the orbiting scroll 4. That is, as shown in FIG. 8 which is a cross-sectional view taken along a line D-D in FIG. 7, the slide plate 27 is provided at the back surface plate 4E which is provided on the back surface side of the end plate 4A of the orbiting scroll 4. The abrasion powders which are produced by the slide plate 27 are scattered on the bark surface side of the end plate 4A by the cooling air which passes the orbiting scroll side cooling air path 21. Thereby, it is possible to reduce the intrusion of the brush abrasion powders into the face seal 23.

Figure 9:
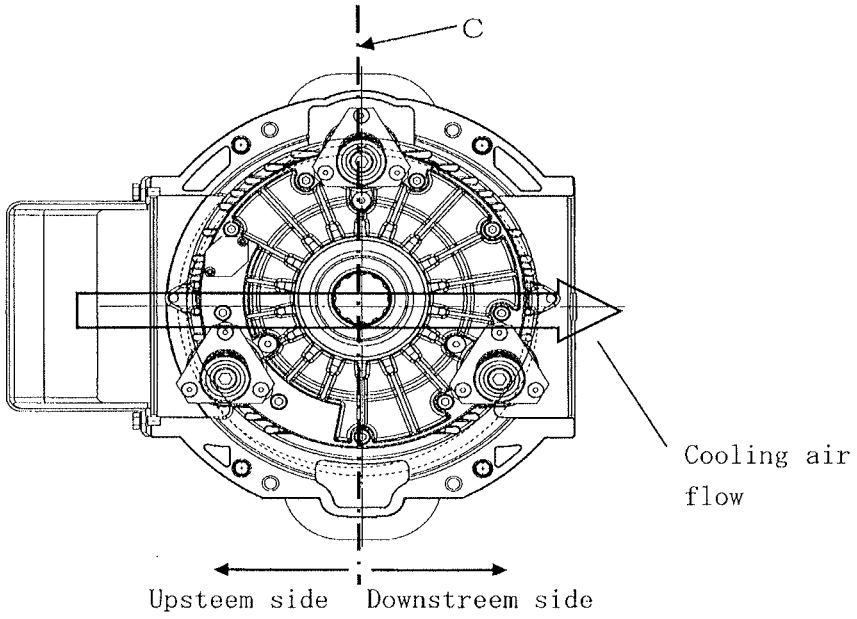
FIG. 9 is a rear view which illustrates a setting area of a conductive brush sliding portion in an alternative 1 of the present invention.

Moreover, in an alternative 1 of the present invention, the slide portion for the orbiting scroll side conductive brush 24A is provided on a downstream side relative to a center line of the end plate 3A of the fixed scroll 3 shown in FIG. 9 illustrating the side surface side cooling air path and on a downstream side relative to a center line C of the end plate 4A of the orbiting scroll 4. Thereby, the cooling air flows in one direction and does not flow back, so that it is possible to reduce the intrusion of the brush abrasion powders into the face seal 23.

Figure 10:
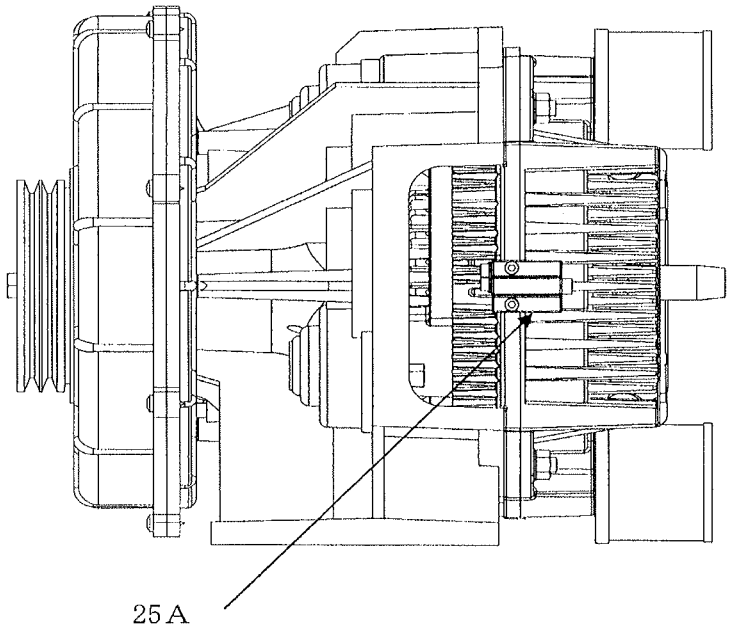
FIG. 10 is a side view which illustrates a setting area of a conductive brush sliding portion in an alternative 2 of the present invention.
Figure 11:
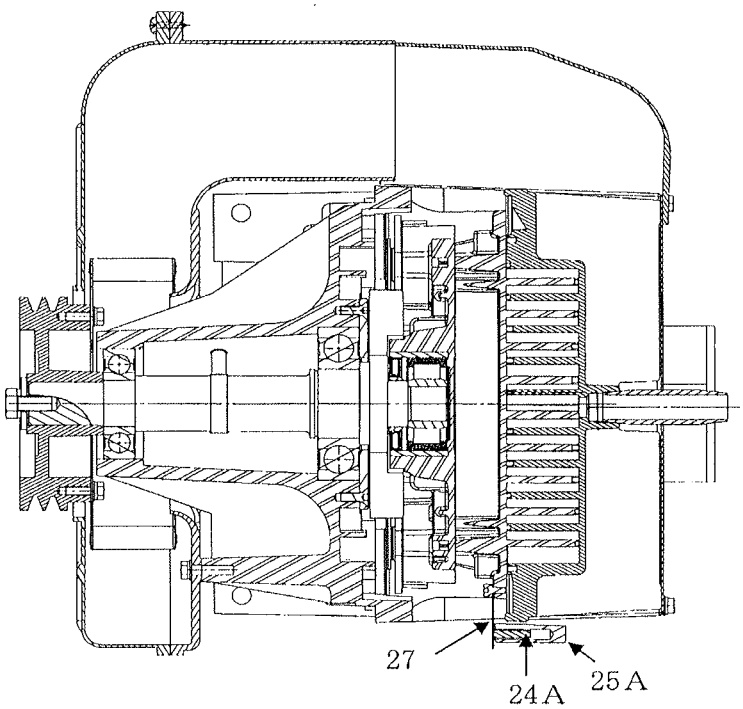
FIG. 11 is a horizontal cross-sectional view of the compressor in FIG. 10.

Moreover, in an alternative 2 of the present invention, as shown in FIGS. 10 and 11, the slide portion for the orbiting scroll side conductive brush 24A is arranged on a downstream side relative to fixed scroll 3 and the orbiting scroll 4 (a downstream side relative to a surface into which the fixed scroll side cooling air path 20, the orbiting scroll side cooling air path 21, and the side surface side cooling air path are joined). Thereby, the cooling air flows in one direction and does not flow backs, so that the abrasion powders are scattered by the cooling air and do not enter the interior of the compressor and the intrusion of the abrasion powders into the face seal 23 can be reduced.

Figure 12:
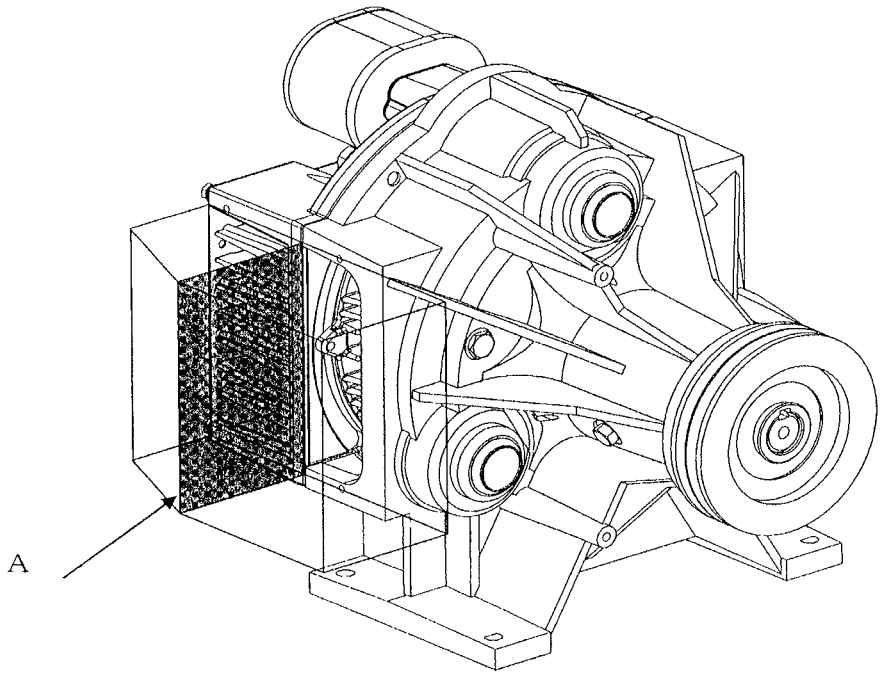
FIG. 12 is an arrow view which illustrates a fixed scroll and a flange surface of a casing in an alternative 3 of the present invention.

Furthermore, in an alternative 3 of the present invention, the slide portion for the orbiting scroll side conductive brush 24A is provided on a cooling air downstream side relative to the support portion 3C for the fixed scroll 3 inside the fan duct 16 in such a manner to be indicated in FIG. 12 by a surface A and relative to the flange surface fastening the casing 2 or in the fixed scroll side cooling air path 20. Thereby, the brush abrasion powders are scattered into the fixed scroll side cooling air path 20, so that the brush abrasion powders can be prevented from intruding the orbiting scroll side cooling air path 21 and the intrusion of the brush abrasion powders into the face seal 23 can be reduced.

In any case of this embodiment and the alternatives 1-3, the slide surface between the orbiting scroll side conductive brush 24A and the slide plate 27 is provided in the cooling air path while reducing the intrusion of the abrasion powders produced from the slide surface for the orbiting scroll side conductive brush 24A into the face seal 23, so that frictional heat generated by the sliding can be effectively cooled. On the other hand, the intrusion of the abrasion powders generated from the slide surface for the orbiting scroll side conductive brush 24A into the face seal 23 can be reduced at the position except for the position in which the cooling air is supplied to the face seal 23, so that the slide surface for the orbiting scroll side conductive brush 24A is not necessarily provided in the cooling air path. For example, the slide surface for the orbiting scroll side conductive brush 24A may be provided at a position spaced apart from the fixed scroll 3 relative to the cooling fin cover 19 (outside the cooling air path). In this case, the cooling air is not supplied to the slide surface for the orbiting scroll side conductive brush 24A, so that if the cooling air flows back in the cooling air path, the abrasion powders generated from the slide surface for the orbiting scroll side conductive brush 24A do not intrude into the face seal 23. Moreover, if the orbiting scroll side conductive brush 24A itself is arranged in the cooling air path, the frictional heat produced by the sliding can be effectively cooled.

Figure 13:
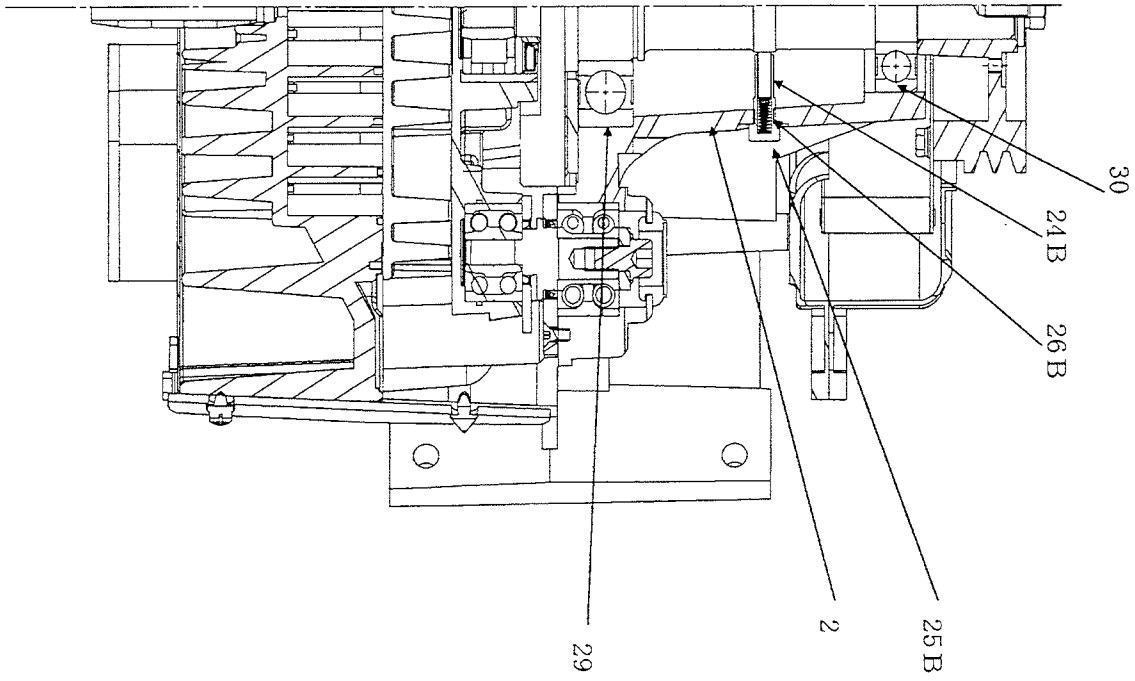
FIG. 13 is a cross-sectional view of the embodiment of the present invention in which a brush is attached to a drive shaft.

Referring now to FIG. 13, the position in which the slide surface for the drive shaft side conductive brush 24B is provided will be explained.

In this embodiment, the slide surface for the drive shaft side conductive brush 24B which causes the drive shaft 8 and the casing 2 to be the same electrical potential is arranged in the position except for the position in which the cooling air generated by the cooling fan 28 is supplied to the face seal 23. For example, as shown in FIG. 13, the slide surface for the drive shaft side conductive brush 24B is provided in a closed space which is formed between the drive shaft 8 and the casing 2, and the plurality of bearings 29, 30 rotatably supporting the drive shaft 8. Thereby, it is possible to prevent the abrasion powders from scattering to the outside and prevent the abrasion powders from being sucked into the fan duct 16 from the cooling air suction opening and intruding into the face seal 23 of the minor surface of the orbiting scroll 4.

In a case where the bearings 29, 30 are grease-lubricated, oil seals which prevent a grease leakage are provided at the bearings 29, 30. When the compressor body 1 is stood up (the drive shaft 8 is directed in a vertical direction) at the time of maintenance, the abrasion powders which are produced by the sliding of the drive shaft side conductive brush 24B and accumulated in the closed space formed between the drive shaft 8 and the casing 2, and the plurality of bearings 29, 30 are moved toward the bearings 29, 30 and, at the time of re-operation after the maintenance, intrude into the bearings 29, 30 from a clearance between the oil seals provided at the bearings 29, 30 and the casing 2, and the drive shaft 8, so that there is a possibility that the life span of the bearings 29, 30 will be considerably reduced. Therefore, a maintenance port for removal of the abrasion powders of the drive shaft side conductive brush 24B which, at the time of the maintenance or the like, allows the abrasion powders to be removed from the closed space formed between the plurality of bearings 29, 30 rotatably supporting the drive shaft 8, and the drive shaft 8 and the casing 2 may be provided. Thereby, if the maintenance port is opened at the time of the maintenance of the compressor body 1 and the abrasion powders are removed from the maintenance port, it is possible to suppress a reduction in life span of the bearings 29, 30. Moreover, the maintenance portion is closed at the time of the operation of the compressor body 1, whereby the space surrounded by the drive shaft 8, the casing 2, and the plurality of bearings 29, 30 is made the closed space and it is possible to prevent the white layer-delamination of the orbiting bearing 11 while preventing the abrasion powders produced by the cooling fan 23 from intruding into the face seal 23.

The shape of the maintenance port is of a hole-shape and the maintenance port is closed by, for example, a rubber cap, at the time of the operation of the compressor body. Moreover, the hole may be female-threaded and closed by a bolt or the like. Furthermore, the maintenance port may be composed of an openable and closable door or the like and, if the opening of the maintenance port is made larger, work of removing the abrasion powders can be easily performed.

Moreover, the holder 25B which is attached to the casing 2 and holds the drive shaft side conductive brush 24B is arranged in the proximity of the cooling air suction opening and at the position to which the cooling air is supplied, so that the frictional heat generated by the sliding of the drive shaft side conductive brush 24B and the drive shaft 8 can be cooled through the holder 25B.

According to what is described above, even in a case of the compressor operation at the higher rotation speed and with the higher load relative to the prior art, it is possible to prevent the electrical charges of the orbiting scroll 4 and drive shaft 8 by the orbiting scroll side conductive brush 24A and the drive shaft side conductive brush 24B and obtain the reliability of the face seal 23 while preventing the white layer-delamination of the orbiting bearing 11. Moreover, it is possible to provide a structure which improves the reliability of the orbiting bearing 11 without largely varying the outer diameter size of the body.

The embodiments which have been described above should be considered in all respects illustrative and are not intended to limit the scope of the present invention. Namely, modifications and variations are possible without departing from the spirit and scope of the present invention.

What is claimed is:

1. A scroll-type fluid machine comprising:

a casing;

a fixed scroll having a flange surface attached to the casing, and a wrap portion provided on a surface of an end plate;

an orbiting scroll having a wrap portion provided on a surface of an end plate, and provided in an opposed relationship with the fixed scroll, and orbiting with respect to the casing;

a back surface plate provided at a back surface of the end plate of the orbiting scroll, a drive shaft connected through a crank portion to the orbiting scroll and performing rotation-drive;

a cooling fan supplying cooling air into an interior of the casing;

a plurality of compression chambers which are defined between the wrap potion of the fixed scroll and the wrap portion of the orbiting scroll; and a conductive brush causing the orbiting scroll and the casing to be conducted by causing the back surface plate and the casing to be conducted.

2. The scroll-type fluid machine according to claim 1, wherein the conductive brush is arranged at a position except a position at which abrasion powders produced by the conductive brush sliding relative to a slide portion of the conductive brush is supplied to the compression chambers.

3. The scroll-type fluid machine according to claim 2, further comprising:

a fan duct which is formed on outer sides of the orbiting scroll and fixed scroll and conducts the cooling air produced by the cooling fan to the orbiting scroll and the fixed scroll.

4. The scroll-type fluid machine according to claim 2, further comprising:

a cooling air path which is formed by a space between the fixed scroll and the orbiting scroll, and the casing, and the fan duct.

5. The scroll-type fluid machine according to claim 4, wherein the cooling air path has: an orbiting scroll side cooling air path formed between the back surface of the orbiting scroll and the casing; a side surface side cooling air path formed between outer circumferential surfaces of the orbiting scroll and fixed scroll and the casing; and a fixed scroll side cooling air path formed between the fixed scroll and the casing.

6. The scroll-type fluid machine according to claim 5, wherein a slide surface for the conductive brush is arranged in the orbiting scroll side cooling air path.

7. The scroll-type fluid machine according to claim 5, wherein a slide surface for the conductive brush is arranged on a cooling air downstream side of the side surface side cooling air path relative to a center line of the fixed scroll and on a cooling air downstream side relative to a center line of the orbiting scroll.

8. The scroll-type fluid machine according to claim 5, wherein a slide surface for the conductive brush is arranged on a downstream side of the fan duct relative to the flange surface of the fixed scroll attached to the casing or arranged in the fixed scroll side cooling air path.

9. The scroll-type fluid machine according to claim 5, wherein a slide surface for the conductive brush is arranged on a cooling air downstream side relative to the fixed scroll and the orbiting scroll.

10. The scroll-type fluid machine according to claim 4, wherein the conductive brush is arranged outside the cooling air path.

11. The scroll-type fluid machine according to claim 1, wherein a slide surface for the conductive brush is located between the conductive brush and a slide plate attached to the back surface plate.

12. The scroll-type fluid machine according to claim 1, further comprising:

a drive shaft side conductive brush causing the casing and the drive shaft to be conducted.

13. A scroll-type fluid machine comprising:

a casing;

a fixed scroll having a flange surface attached to the casing, and a wrap portion provided on a surface of an end plate;

an orbiting scroll having a wrap portion provided on a surface of an end plate, and provided in an opposed relationship with the fixed scroll, and orbiting with respect to the fixed scroll;

a back surface plate provided at a back surface of the end plate of the orbiting scroll;

a drive shaft connected through a crank portion to the orbiting scroll and performing rotation-drive; and a conductive brush causing the back surface plate and the casing to be conducted.

14. The scroll-type fluid machine according to claim 13, further comprising:

a cooling fan supplying cooling air into an interior of the casing;

a plurality of compression chambers which are defined between the wrap potion of the fixed scroll and the wrap portion of the orbiting scroll;

wherein the conductive brush is arranged at a position except a position at which abrasion powders produced by the conductive brush sliding relative to a slide portion of the conductive brush is supplied to the compression chambers.

15. The scroll-type fluid machine according to claim 13, wherein a slide surface for the conductive brush is located between the conductive brush and a slide plate attached to the back surface plate.

16. The scroll-type fluid machine according to claim 13, further comprising:

a drive shaft side conductive brush causing the casing and the drive shaft to be conducted.

* * * * *